United States Patent [19]

Kitai

[11] Patent Number: 4,739,704

[45] Date of Patent: Apr. 26, 1988

[54] JAW FOLDING DEVICE FOR A JAW CYLINDER OF JAW-TYPE FOLDER

[75] Inventor: Mitsuo Kitai, Kanagawa, Japan

[73] Assignee: Kabushikigaisha Tokyo Kikai Seisakusho, Tokyo, Japan

[21] Appl. No.: 933,206

[22] Filed: Nov. 21, 1986

[30] Foreign Application Priority Data

Dec. 2, 1985 [JP] Japan ..... 60-185823

[51] Int. Cl.[4] ..... B41F 1/28

[52] U.S. Cl. ..... 101/415.1

[58] Field of Search ..... 101/409, 408, 415.1, 101/415

[56] References Cited

U.S. PATENT DOCUMENTS 4,459,913 7/1984 Kowalik ..... 101/409
4,503,772 3/1985 Urakawa ..... 61/409

FOREIGN PATENT DOCUMENTS 3130689 7/1982 Fed. Rep. of Germany ..... 101/409
57-90359 6/1982 Japan .
58-153042 10/1983 Japan .
59-5010 2/1984 Japan .

*Primary Examiner*—E. H. Eickholt
*Attorney, Agent, or Firm*—Schwartz, Jeffery, Schwaab, Mack, Blumenthal & Evans

[57] ABSTRACT

The present invention relates to a jaw folding device for a jaw cylinder of jaw-type folder and comprises a mother member detachably fixed in the groove formed in the cylinder, a fixed jaw plate fixed to the mother member, a controlled jaw plate so arranged as to contact to the fixed jaw plate a controlled jaw plate shaft for fixing the controlled jaw plate and pivotably supported on the mother member, an urging means for urging the controlled jaw plate to the fixed jaw plate and an angular control means for changing the angle of the controlled jaw plate shaft. The angular control means is actuated by a cam mechanism. The controlled jaw plate is isolated from the fixed jaw plate as the angular control means is actuated. The mother member of this jaw folding device can be easily dismounted from the cylinder drum so that the jaw folding device can be removed from the jaw-type folder to perform checking, maintenance, adjustment or replacement it.

3 Claims, 4 Drawing Sheets

JAW FOLDING DEVICE FOR A JAW CYLINDER OF JAW-TYPE FOLDER

BACKGROUND OF THE INVENTION

1. Field of the Invention

The present invention generally relates to a jaw folding device of jaw-type folder. More particularly, the present invention relates to a jaw folding mechanism of a jaw cylinder of a jaw folding device for jaw folding papers to be printed to form a folded print.

2. Description of the Prior Art

A conventional jaw folding mechanism for a jaw cylinder of a jaw folding device has been shown in Japanese Patent Application Open Publication No. Sho. 57-90359, Japanese Patent Application for Utility Model Open Publication No. Sho. 58-153042 and Japanese Patent for Utility Model Publication No. Sho. 59-5010.

For instance, the above publications No. Sho. 57-90359 and No. Sho. 59-5010 have provided one example of jaw folding as shown in FIG. 5 and FIG. 6. In the drawings, the jaw folding device comprises cylinder 300, a controlled jaw plate shaft 301 rotatably arranged within the groove formed in the cylinder 300 and protruding out both sides of the cylinder 300, arms 302 and, 302' fixed on the respective ends of the shaft 301, and a controlled jaw plate 303 fixed in the groove. Further, a fixed jaw plate 304 is formed on the edge of the groove of the cylinder 300 so as to face the controlled jaw plate 303. A guide rod 307 provided with a spring 305 is secured to one end of the arm 302 so as to urge the controlled jaw plate 303 toward the fixed jaw plate 304 through the urging force of the spring 305. The other end of the arm 302 is connected to a cam follower 308 which follows along the external surface of a cam 309 fixed on a machine base 310. The controlled jaw plate shaft 301 is angularly changed in accordance with the following motion of this cam follower 308 and, thus, the controlled jaw plate 303 can be isolated from the fixed jaw plate 304.

The above described conventional art No. Sho. 58-153042 provides another example of a jaw folding device, as shown in FIG. 7 and FIG. 8. In the drawings, the jaw folding device comprises a cylinder 400, a controlled jaw plate shaft 401 pivotably arranged in a groove of the cylinder 400 in such manner that at least one end of the shaft 401 protrudes from the side surface of the cylinder 400, an arm 402 fixed on the one end of the shaft 401, a controlled jaw plate 403 fixed to the shaft 401 within the groove, and an arm 411 for receiving a spring 405. A fixed jaw plate 404 is arranged at the edge of the groove formed in the cylinder 400 so as to face to the controlled jaw plate 403. In the bottom of the groove in the cylinder 400 a pair of recesses is coaxially formed with the arm 411 to receive the spring 405. A guide rod 407 is inserted in the coil 405 and its bottom end is fixed at each the recess, so as to press the controlled jaw plate 403 to the fixed jaw plate 404. The top end of the guide rod 407 is slidably inserted into an opening formed in the arm 411, so that the lower surface of the arm 411 is subjected to the urging force caused by the spring 405. Further, the arm 402 is provided with a cam follower 408 which follows along the external surface of a cam 409. According to the motion of this cam 409 the controlled jaw plate shaft 401 is angularly changed to allow the controlled jaw plate 403 to be isolate from the fixed jaw plate 404.

However, such conventional structure may cause various problems. That is the jaw folding force for holding a paper between the controlled jaw plate and the fixed jaw plate is supplied by the urging means such as the spring and the guide rod; this jaw folding force is one of the most important factors for this jaw folding device. This urging means is fixedly arranged in the cylinder so that such means will be installed in an extermely narrow space when the cylinder is assembled within a folding apparatus. This requires complicated operation and long times for the maintenance, checking, adjustment, and replacement of the jaw folding device. Further this structure limits working position for such activities, so that the operators may be endangered.

SUMMARY OF THE INVENTION

It is an object of the present invention to provide an improved jaw folding device for a jaw cylinder of jaw-type folder which can be easily dismounted from the cylinder if any trouble develops in the jaw folding device and in order to carry out the maintenance, checking, adjustment or displacement of the jaw folding device and to further accomplish fine tuning of the device accurately and quickly.

Another object of this invention is to provide an improved jaw folding device for a jaw cylinder of a jaw-type folder which can ensure the safety of the operator attending to the maintenance work.

A further object of this invention is to provide an improved jaw folding device for a jaw cylinder of jaw-type folder which can ensure a high working ratio of this printing machine.

To accomplish the above described objects, the jaw folding device for a jaw cylinder of jaw-type folder according to the present invention comprises a mother member detachably fixed in the groove formed in the cylinder, a fixed jaw plate fixed to the mother member, a controlled jaw plate so arranged as to contact to the fixed jaw plate, a controlled jaw plate shaft for fixing the controlled jaw plate and pivotably supported on the mother member, an urging means for urging the controlled jaw plate to the fixed jaw plate, and an angular control means for changing the angle of the controlled jaw plate shaft.

The above and other objects and features of the invention will appear more fully hereinafter from a consideration of the following description taken in connection with the accompanying drawing wherein one embodiment is illustrated by way of example.

DETAILED DESCRIPTION OF THE PREFERRED EMBODIMENT

Figure 1:
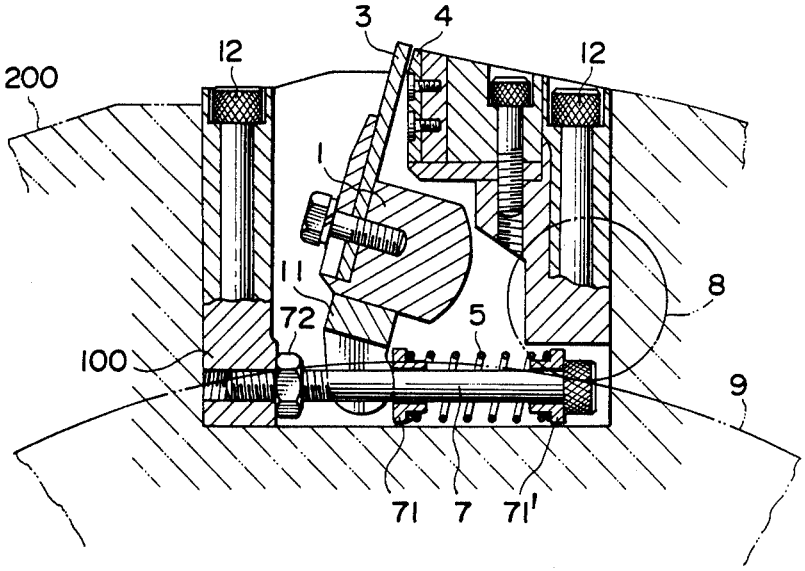
FIG. 1 is a schematic sectional view showing one example of preferred embodiment of the jaw folding device according to the present invention.
Figure 2:
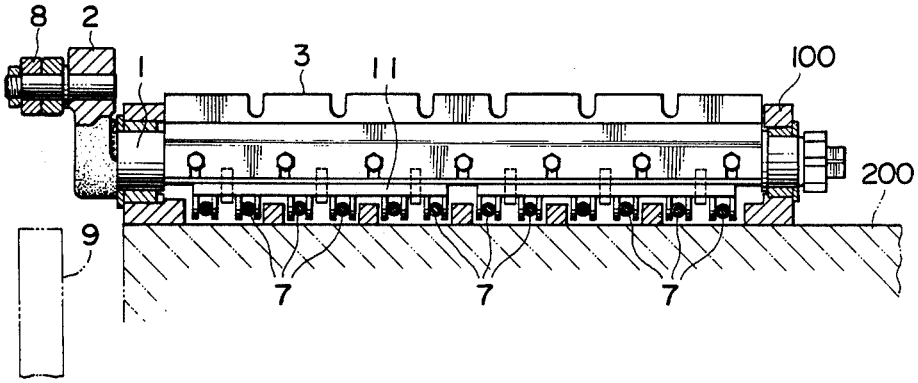
FIG. 2 is a schematic sectional view showing the jaw folding device at right angle with FIG. 1.

FIG. 1 and FIG. 2, show a preferred embodiment of the present invention. In the drawings, the reference numeral 100 denotes a mother member formed in a substantially cage box having a lattice shaped bottom. A controlled jaw plate shaft 1 is pivotably assembled on the mother member 100 through bearings at both longitudinal ends of the mother member 100. At least one end of the shaft 1 protrudes outward from the side wall of the mother member 100 and is fixedly provided with a first arm 2. Further a cam follower 8 is pivotably assembled on the first arm 2.

The controlled jaw plate shaft 1 is fixedly provided with a controlled jaw plate 3 and a second arm 11 for receiving a spring. A fixed jaw plate 4 is fixed on the inner surface of one longitudinal edge of the mother member 100 so as to face with the controlled jaw plate 3 fixed on the controlled jaw plate shaft 1.

In each recessed space of the lattice shaped bottom of the mother member 100, spring guide rods 7 are fixedly arranged. The guide rod 7 is composed of a male screw section in its leg and a head section having larger diameter than that of the leg section. The male screw of the rod 7 is threadingly engaged with a female screw formed in the side wall, facing to the recessed space, of the mother member 100 and fixed by means of a lock nut 72. The leg section of the rod 7 is inserted in a spring 5 having stoppers 71, 71' at both ends thereof, so that one stopper 71 is restrained by the second arm 11 fixed at the shaft 1 and the other stopper 71' is restrained by the head section of the guide rod 7. According to this arrangement, the second arm is urged by the spring 5 and thus the controlled jaw plate 3 is pressed toward the fixed jaw plate 4 about the shaft 1 as a pivot.

The mother member 100 is detachably fit in the groove formed in a jaw cylinder 200 of jaw-type folder through bolts 12. The cam follower 8 is contacted to a cam 9 assembled on a machine base (not shown) when the mother member 100 is assembled in the groove.

The operation of this device is explained as follows.

Figure 3:
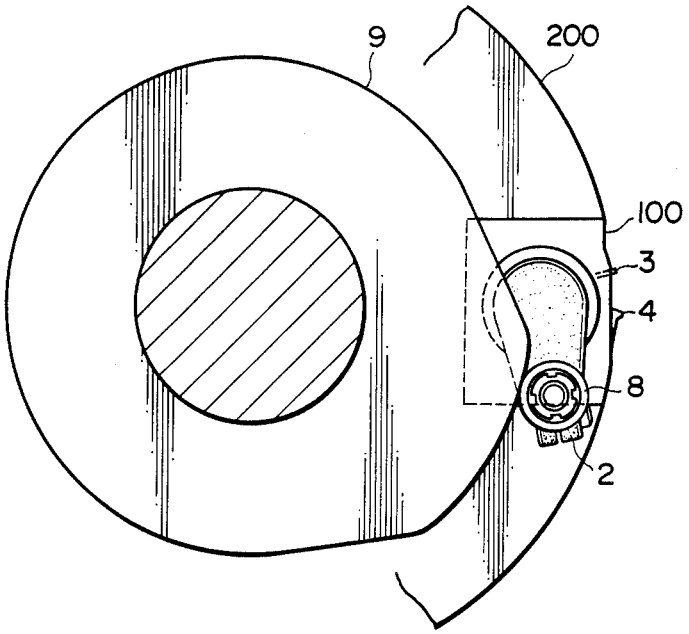
FIG. 3 and FIG. 4 are schematic illustrations showing an operation of the controlled jaw plate and the cam.
Figure 4:
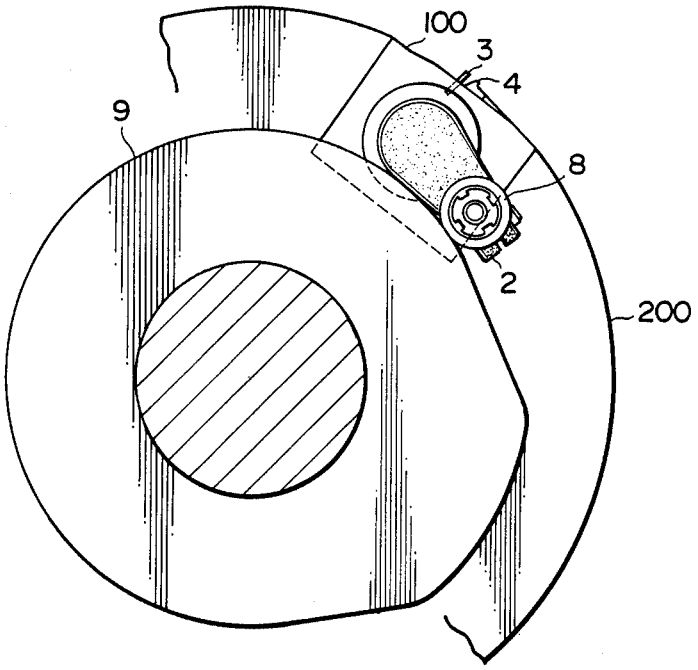
Figure 5:
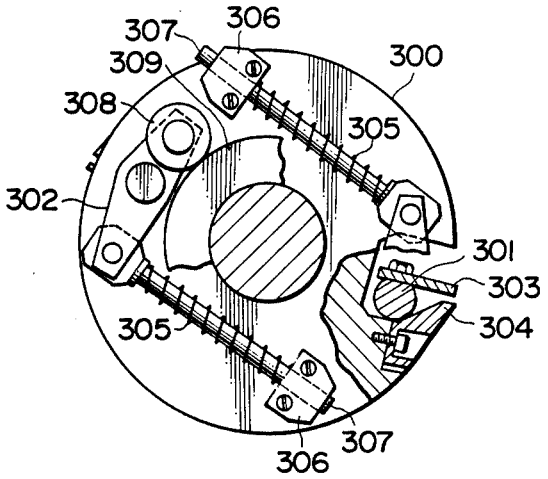
FIG. 5 PRIOR ART
FIG. 5 and FIG. 6 are schematically sectional views showing one conventional jaw folding device.
Figure 6:
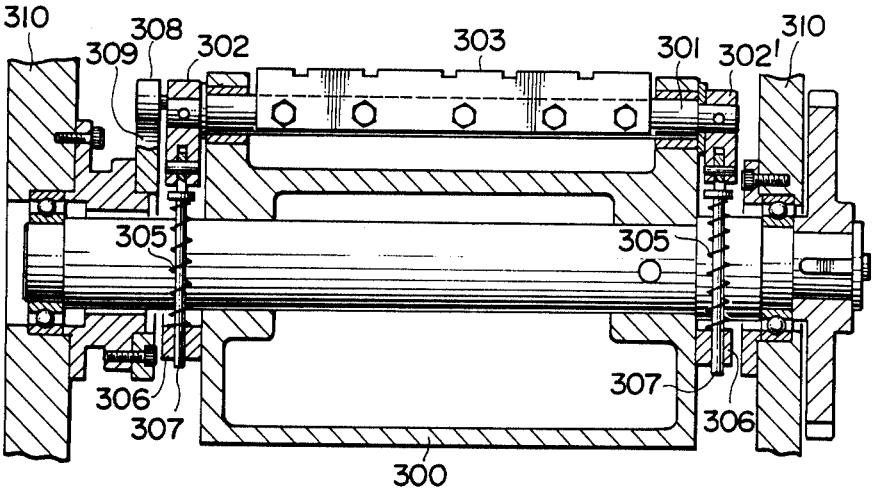
FIG. 6 PRIOR ART
Figure 7:
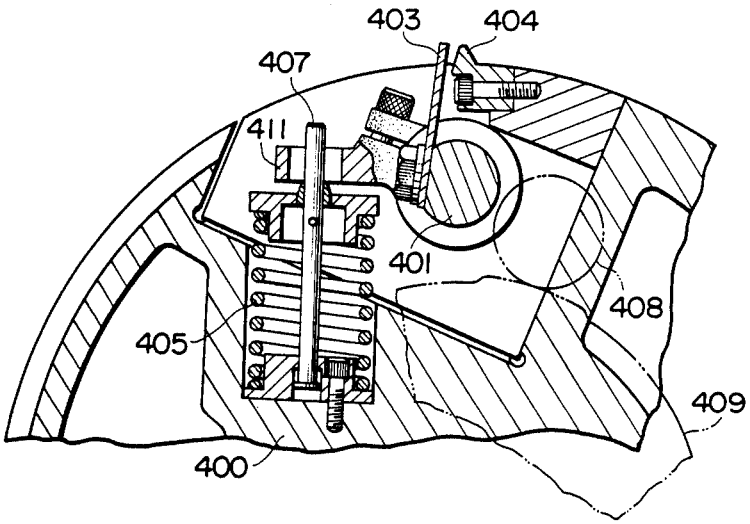
FIG. 7 PRIOR ART
FIG. 7 and FIG. 8 are schematically sectional views showing another convetional jaw folding device.
Figure 8:
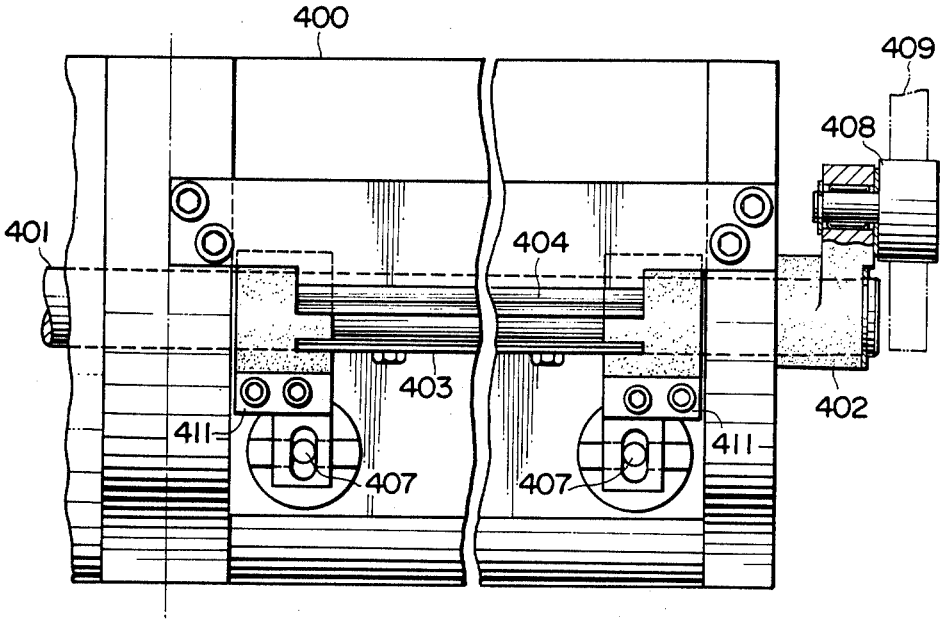
FIG. 8 PRIOR ART

As the cylinder 200 equipped with the mother member 100 is revolved by a driving means, not shown, the cam follower 8 also moves along the external surface of the cam 9. When the cam follower 8 rides on the convex portion of the cam 9 as shown in FIG. 3, the first arm 2 moves outwards following the cam and the controlled jaw plate shaft 1 is a angularly changed. Thus the second arm 11 is also revolved, so that the spring 5 urging the controlled jaw plate 3 toward the fixed jaw plate 4 is compressed by the second arm 11. The controlled jaw plate 3 is released from the urging force by the spring 5 and therefore isolated from the fixed jaw plate 4. Succeedingly, as the cam follower 8 passes over the convex portion and moves along the ordinary circular portion of the cam 9 as shown in FIG. 4, the controlled jaw plate shaft 1 is forcibly revolved by the returning force of the spring 5. Thus the controlled jaw plate 3 is forcibly pressed to the fixed jaw plate 4.

Fine tuning for this pressing force of the controlled jaw plate 3 to the fixed jaw plate 4 can be carried out by adjusting the threading engagement between the male screw of the guide rod 7 and the female screw of the mother member 100.

In order to perform the checking, maintenance, adjustment or replacement of this jaw folding device, the jaw folding device itself can be removed from the cylinder 1 by releasing the bolts 12.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

What is claimed is:

1. A jaw folding device for a jaw cylinder of jaw-type folder comprising;

a mother member formed in a substantially cage-shaped box having a lattice bottom detachably fixed in the groove formed in the cylinder;

a fixed jaw plate fixed to the mother member;

a controlled jaw plate so arranged as to contact the fixed jaw plate;

a controlled jaw shaft for fixing the controlled jaw plate, the controlled jaw shaft being pivotably supported on the mother member;

an urging means for urging the controlled jaw plate to the fixed jaw plate; and an angular control means for changing the angel of the controlled jaw plate shaft.

2. The jaw folding device as set forth in claim 1, wherein the urging means comprises at least one unit consisting of a spring, a guide rod for the spring, spring stoppers, and an arm for receiving the spring.

3. The jaw folding device as set forth in claim 1, wherein the angular control means comprises an arm connected to the controlled jaw plate shaft, a cam follower, and a cam.

* * * * *